United States Patent [19]

Deal et al.

[11] 3,953,324

[45] Apr. 27, 1976

[54] REMOVAL OF SOLVENT

[75] Inventors: Carl H. Deal, Houston, Tex.; Stephen H. Garnett, Tivon, Israel

[73] Assignee: Shell Oil Company, Houston, Tex.

[22] Filed: Dec. 4, 1974

[21] Appl. No.: 529,430

[52] U.S. Cl. ..... 208/321; 208/325; 260/705

[51] Int. Cl.[2] ..... C10G 21/22; C10G 21/28

[58] Field of Search ..... 208/321, 325; 260/705

[56] References Cited

UNITED STATES PATENTS

| | | | |
|---|---|---|---|
| 2,964,465 | 12/1960 | Brown et al. | 208/321 |
| 3,470,087 | 9/1969 | Broughton | 208/321 |
| 3,763,037 | 10/1973 | Thompson | 208/321 |

*Primary Examiner*—Herbert Levine

[57] ABSTRACT

Sulfolane is recovered from the extract and raffinate product streams of an extraction process employing sulfolane as the solvent by contacting the extract and raffinate product streams with a solid adsorbent and regenerating the adsorbent by displacing the adsorbed solvent with extraction process feed.

6 Claims, 3 Drawing Figures

REMOVAL OF SOLVENT

BACKGROUND OF THE INVENTION

This invention relates to the separation of a liquid mixture containing compounds having differing polarities by contacting the liquid mixture with a sulfolane-type solvent in an extraction zone. More particularly, it deals with the removal of sulfolane-type solvent present in the extract and raffinate product streams of the extraction process. Specifically, a processing sequence is disclosed which permits recovery of the sulfolane-type solvent by contacting the extract and raffinate product streams with a solid adsorbent followed by removal of the sulfolane-type solvent from the solid adsorbent by contacting the adsorbent with extraction process feed.

THE PRIOR ART

The separation of liquid organic compounds of differing polarities by means of selective solvents is well known, and various continuous processes for effecting such separations have been proposed. With regard to the removal of aromatics such as benzene, toluene and xylene from hydrocarbon streams, there are at least four viable commercial processes including sulfolane extraction, N-methyl pyrrolidone extraction, dimethylsolfoxide extraction, and formyl morpholine extraction. The dominant process for most new and planned commercial installations is the Shell sulfolane extraction process as initially described by Evans et al, U.S. Pat. No. 2,360,859 (1944).

In the typical extraction process employing a sulfolane-type solvent, the extraction process feed is contacted with the solvent in an extraction zone. The fat solvent is withdrawn from the extraction zone and introduced into an extractive stripper where heat is applied to remove any raffinate material absorbed by the solvent. The raffinate-free fat solvent then passes to a solvent recovery column where steam and/or reboil are employed to remove the extract product from the solvent. The overhead from the solvent recovery column, consisting mainly of the extract product, water vapor, and a small quantity of solvent, is then condensed, and a portion of the condensed extract product is then employed as reflux in the solvent recovery column so as to reduce the amount of solvent in the overhead of the solvent recovery column. However, the extract product in the overhead stream still contains significant amounts of solvent that must be recovered. Because the sulfolane-type solvent employed is water soluble, it is the usual practice to recover the solvent from the extract product stream by contact with an aqueous stream in a subsequent contacting means. The recovery of the solvent from the extract product stream with water is undertaken in any suitable liquid-liquid contacting means as in a tower containing suitable packing such as Berl saddles or Raschig rings, or in a tower containing suitable trays, or in a rotating disc contactor. The solvent is then readily recovered from the aqueous solution by distillation. Likewise, the raffinate product stream taken as overhead from the initial extraction zone is contacted with water so as to remove tract quantities of solvent. Nevertheless, solvent in significant quantities continues to be lost with the raffinate and extract product streams. Also, a large amount of reboil and concomitant condensing capacity are required in the solvent recovery column to reduce the solvent losses in the extract stream. The solvent that is withdrawn with the extract and raffinate product streams must be recovered, not only because the solvent may interfere with subsequent processing of the two streams or the ultimate use of the extract or raffinate, but also because continual loss of solvent in the raffinate and extract streams is a significant economic expense. In the sulfolane extraction process, it is estimated that about 0.035 pounds of sulfolane per barrel of extraction process feed is consumed in the process either through thermal and oxidative degradation of the sulfolane or through loss in the extract and raffinate product streams.

An improved process has been discovered that increases the purity of the raffinate and extract products, decreases the solvent loss, and reduces the heat and cooling requirements in the solvent recovery column.

SUMMARY OF THE INVENTION

The present invention is an improvement in the process for the separation of a liquid mixture containing compounds having differing polarities by contacting the liquid mixture with a sulfolane-type solvent in an extraction zone, which improvment comprises contacting the extract and raffinate product streams with a solid adsorbent so as to recover the sulfolane-type solvent from the raffinate and extract streams, followed by regeneration of the adsorbent by displacing the adsorbed solvent with the extraction process feed.

BRIEF DESCRIPTION OF THE DRAWING

The accompanying drawings diagrammatically illustrate a preferred embodiment of the present invention. Shown therein are an extraction zone, an extractive stripper, a solvent recovery column, a raffinate water wash, adsorption zones revealing both the adsorption cycle and the regeneration cycle, and their interconnections. Pieces of equipment such as pumps, surge vessels, accumulators and the like which are not essential for an understanding of the invention have been omitted for purposes of clarity.

Three drawings accompany and are a part of this disclosure.

DETAILED DESCRIPTION OF THE INVENTION

Figure 1:
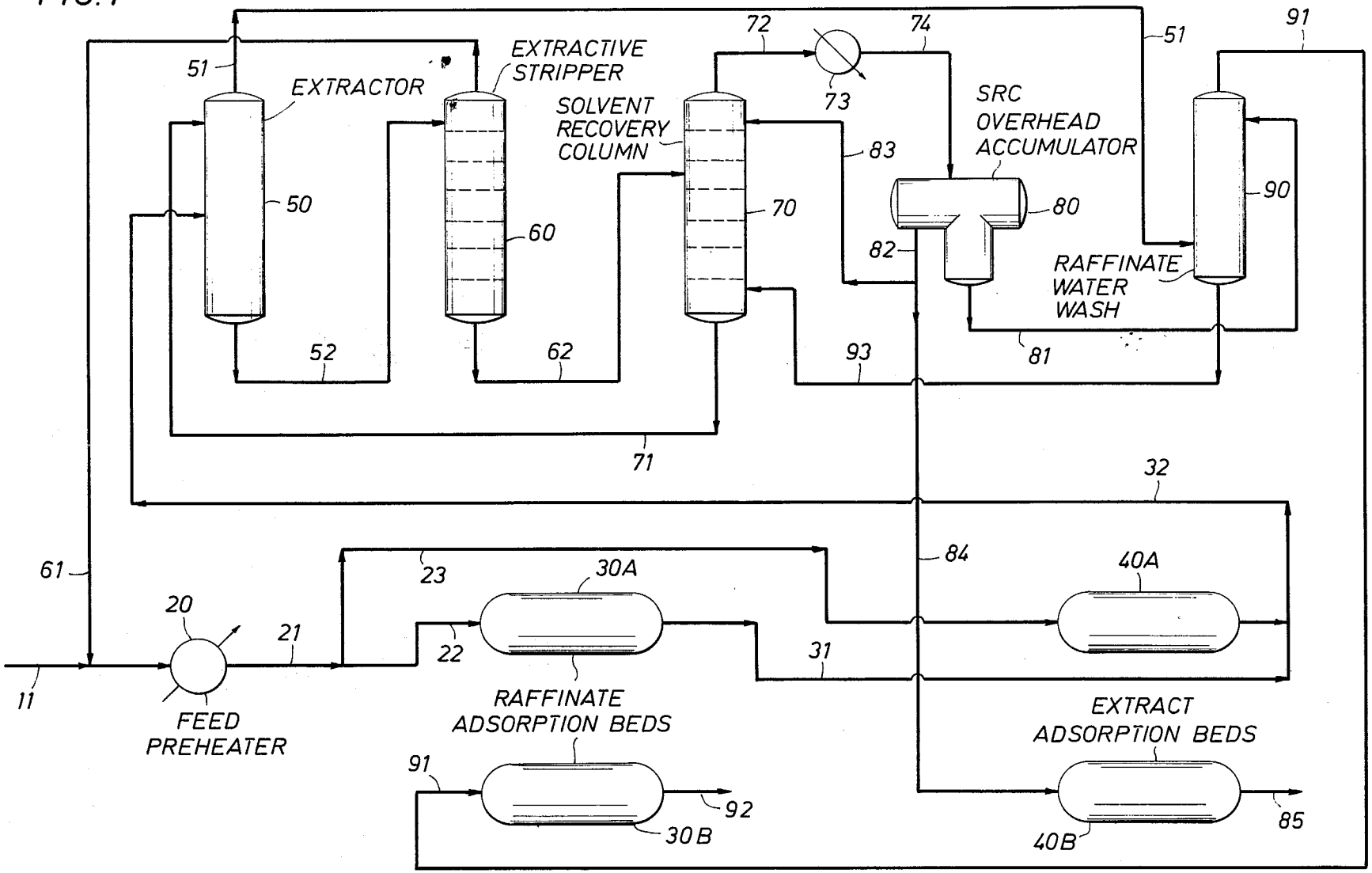
FIG. 1 is a diagrammatic flow sheet showing an integrated process wherein the extraction process and the adsorption beds are shown with their inter-connections.

The present invention teaches the method for recovering sulfolane-type solvents in various extraction processes. The term "sulfolane-type solvent" encompasses a compound possessing a five-membered ring containing one atom of sulfur and four atoms of carbon, with two oxygen atoms bonded to the sulfur atom of the ring. In general, the sulfolane-type solvents have the following structural formula:

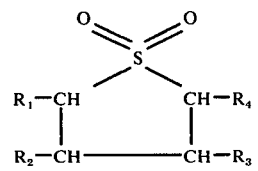

wherein $R_1$, $R_2$, $R_3$, and $R_4$ are selected from the group comprising hydrogen, an alkyl group of from one to 10 carbon atoms, an alkoxy radical of from one to eight carbon atoms, and an arylalkyl radical of from one to twelve carbon atoms. Since sulfolane, also known as tetrahydrothiophene 1,1-dioxide or tetramethylene sulfone, is the principal sulfolane-type solvent employed in commercial processes, references to particular extraction processes and illustrative embodiments within the patent specification employ sulfolane as the sulfolane-type solvent.

The primary use of sulfolane is in the extraction of aromatic compounds such as benzene, toluene, and xylene from reformate or hydrotreated pyrolysis naptha feeds. Other applications of sulfolane include acid gas removal (Shell Development Company Sulfinol Process); extractive distillation of closely boiling products such as n-propyl alcohol and secbutyl alcohol; fractionation of fatty acids and oils into saturated and unsaturated portions; recovery of sulfur dioxide; fractionation and decolorization of noncellulosic wood products such as pyroligneous liquids, tars, and tall oil; and in the separation of a wide variety of mixed coal and agricultural chemical products. Additionally, sulfolane has been used as a reaction solvent and for the preparation of isocyanates from phogene and amine salts, as a spinning and casting solvent for acrylonitrile, and in other special applications. See generally, Kirk-Othmer, Encyclopedia of Chemical Technology, Vol. 19, pages 250–53. While the present invention may be effectively employed wherever sulfolane is used, a preferred use of the present invention is in conjunction with the extraction of aromatic compounds from reformate or hydrotreated pyrolysis naptha feeds.

The invention as disclosed herein calls for adsorption of sulfolane from a product stream onto solid adsorbent at one temperature and regeneration of the adsorbent at some higher temperature by displacing the sulfolane adsorbed onto the solid adsorbent with extraction process feed.

It should be noted that the present invention is employed to remove solvent from at least one member of the group consisting of the raffinate product stream, the extract product stream, and the raffinate product stream plus the extract product streams.

There are a number of solid adsorbents that are employed in the present invention. Acceptable adsorbents include polar adsorbents such as alumina, barium sulfate, calcium carbonate, glass powder, ion-exchange resins, quartz, silica gel, titanium dioxide and most metallic oxides, and zeolites, as well as non-polar adsorbents such as charcoal, carbon black, graphite, and organic resins. Preferred adsorbents are silica gel, activated alumina, and activated charcoal. Especially preferred as an adsorbent is silica gel.

A measure of the suitability of an adsorbent is its ultimate capacity and working capacity. The ultimate capacity of an adsorbent is herein defined as the grams of sulfolane adsorbed per 100 grams of adsorbent at 25°C in equilibrium with a hydrocarbon product stream containing 1.4% by weight sulfolane. The working capacity of an adsorbent is defined as the difference between the ultimate capacity of the adsorbent in the product stream at 25°C and the equilibrium capacity of the spent adsorbent in the extraction feed stream containing no sulfolane at the regeneration temperature. The ultimate capacity of an adsorbent is a function of the type of adsorbent, the concentration of sulfolane in the product stream, the composition of the product stream, the composition of the extraction feed stream, the temperature of the product stream, and the temperature of the extraction feed stream.

It is estimated that the ultimate capacity of one silica gel (Davison, Grade 12, 28-200 mesh) is about 28 grams of sulfolane per 100 grams of silica gel in a toluene stream containing 1.4% weight sulfolane at 25°C. When the silica gel at its equilibrium capacity is regenerated at 76°C by contacting the adsorbent with a stream consisting of 50% volume toluene and 50% volume heptane, the working capacity is calculated to be about 6.3 gram sulfolane per 100 grams adsorbent or about 25% of the ultimate capacity in toluene at 25°C. If the same temperature cycle is used for purification of the paraffinic raffinate, heptane, it is calculated that the working capacity nearly equals the ultimate capacity at 25°C. If regeneration is carried out at 62°C instead of 76°C, the working capacity of silica gel for the purification of the aromatic stream, toluene, is 4.2 g sulfolane/100 g silica gel.

One activated alumina (Alcoa, grade F-20) had an ultimate capacity of about 7 g sulfolane per 100 grams adsorbent in toluene and a working capacity of about 4.8 g sulfolane per 100 g adsorbent at an adsorption temperature of 25°C and a regeneration temperature of 76°C. The ultimate capacity of an activated charcoal (Matheson Coleman and Bell, Darco, 20-40 mesh) at 25°C when equilibrated with 1.4% sulfolane in toluene is about 2.9 g sulfolane per 100 g adsorbent.

Typically, the adsorption temperature of the product stream to be treated according to the invention is about 10°C to about 50°C, preferrably from about 20°C to about 30°C. In general, the greater the difference between the adsorption temperature and the regeneration temperature, the greater is the working capacity of the adsorbent. Typically, the adsorbent is regenerated by contact with the extraction process feed stream at a temperature of from about 60°C to about 100°C, preferrably from about 70°C to about 80°C.

The adsorbent is preferrably contained in two or more vessels so that while one adsorbent bed is being employed to remove the solvent from a product stream the other adsorption bed is being regenerated by passing hot extraction process feed through the adsorption bed.

One of the objects of the present invention is to produce product streams containing fewer impurities such as sulfolane. In the usual situation, it is desired to have an extract product stream with a purity in excess of 99%. On the other hand, the raffinate product stream does not require such high standards of purity. Therefore, following regeneration of the adsorption bed employed for the raffinate stream, it is not usually necessary to flush out the extraction feed material even though this results in a small amount of extract material in the final raffinate material, whereas, it may be necessary to first flush out the small amount of extraction zone feed from the regenerated extract stream adsorption bed by passing extract through the bed until all trace of raffinate are removed. The specific design and operation of the adsorption vessels and interconnections are well known in the art.

In the typical aromatics extraction process employing a sulfolane solvent, the sulfolane content of the extract product stream is primarily controlled by varying the reflux in the solvent recovery column — that is, by increasing the amount of reflux, the sulfolane content of the extract product stream is reduced. Additionally, a water washing zone is usually provided whereby the extract product stream is contacted with water in a contacting device, e.g. a rotating disc contactor, such that the trace quantities of sulfolane are removed with the wash water and are then recovered. Typically, the sulfolane content of the water-washed extract product stream is from about 2 ppm weight to about 100 ppm weight. Through use of the present invention, it is possible to reduce even further the sulfolane losses in the extract stream by employing the present invention in conjunction with a high reflux rate on the solvent recovery column and the use of a water washing zone. Alternatively it is possible to eliminate the water washing zone and rely on the present invention to control sulfolane losses. Further, by employing the present invention, it is possible to reduce the heating load and condensing load in the solvent recovery column while not increasing the loss of sulfolane in the extract product stream. At present, the solvent losses in the extract stream are reduced by employing about one half of the extract stream product as reflux in the solvent recovery column. By reducing the reflux in the solvent recovery column, the reboil requirements and the condenser requirements are reduced and accordingly, greater amounts of sulfolane are allowed overhead with the extract stream. The greater amounts of sulfolane in the extract stream are then removed in the adsorbent beds of the present invention. It is estimated in a typical benzene-toluene-xylene process that if the amount of reflux is reduced from ½ of the extract stream to about ⅓ of the extract stream, total process heat needs are reduced about 10% and total process cooling water needs are reduced 20% without any additional loss of solvent in the extract stream.

Sulfolane losses in the raffinate product stream of an extraction process are usually reduced by employing a water washing zone similar to that used for the extract product stream. Typically, the sulfolane losses in the raffinate product stream run from about 2 ppm weight to about 100 ppm weight. By use of the present invention along with the water washing zone, the sulfolane losses are reduced further. Alternatively, the present invention is used in place of the usual water washing zone.

DETAILED DESCRIPTION OF THE DRAWING

A fuller understanding of the present invention is obtained by reference to the accompanying drawings which describe a preferred embodiment of the invention wherein a benzene-toluene-xylene mixture is separated from a reformate feed by use of sulfolane as the solvent.

Referring to FIG. 1, hydrocarbon reformate feed containing benzene, toluene, and xylene enters the process along line 11 and is joined with extractive stripper overhead along line 61 before entering the feed preheater 20. After being heated to a temperature of from about 70°C to about 77°C, the extraction process feed stream then contacts the raffinate stream adsorption bed 30A along lines 21 and 22 and the extract stream adsorption bed 40A along lines 21 and 23. Both the extraction stream adsorption bed 40A and the raffinate stream adsorption bed 30A had previously been contacted with the extract stream and raffinate stream respectively, so that the solid adsorbent had adsorbed sulfolane from the two streams. The extraction feed stream containing the sulfolane previously adsorbed onto the adsorption beds then pass via lines 31, 41 and 32 to the extraction zone 50. In the drawing, beds 30A and 40A are arranged as parallel beds, such that the hot extraction process feed passes through each bed individually. Alternatively, the beds may be arranged in series such that the hot extraction process feed passes through one bed and then through the next bed.

Lean sulfolane from the bottoms of the solvent recovery column 70 enters the extraction zone near the top of the extraction zone via line 71 where it contacts extraction feed so as to separate the raffinate from the extract. The raffinate overhead from the extraction zone consisting mostly of saturated hydrocarbons along with small amounts of sulfolane pass via line 51 to the raffinate water wash section 90 where the stream is contacted with water from the overhead of the solvent recovery column via line 81. The overhead from the raffinate water wash section then passes by way of line 91 to adsorption bed 30B where the sulfolane in the raffinate stream is adsorbed onto the solid adsorbant, the temperature of raffinate stream passing to the adsorption bed generally being between about 21°C and 38°C. Once the solid adsorbent in bed 30B has reached its equilibrium capacity, the raffinate stream is switched to bed 30A which had previously been regenerated, and then bed 30B is regenerated by passing extraction feed through the bed. In this manner, continuous operation of the invention may be obtained. The bottoms from the raffinate water wash section 90 consisting of sulfolane-rich water is routed via line 93 to the solvent recovery column.

The bottom stream from the exraction zone 50 is the fat solvent and passes by way of line 52 to the extractive stripper 60 where heat and/or a stripping agent such as steam is employed to remove any saturates absorbed by the sulfolane in the extraction zone. The overhead from the extractive stripper containing most of the saturates absorbed by the sulfolane in the extraction zone is then recycled to the feed to the extraction zone along line 61. The saturates-free fat solvent stream passes from the extractive stripper to the solvent recovery column 70 along line 62.

In the solvent recovery column 70, heat is applied to remove the extract from the solvent. The bottoms from the solvent recovery column is lean solvent which passes by way of line 71 to the extraction zone. The overhead from the solvent recovery column, consisting of extract, water, and sulfolane, pass by way of line 72 to the overhead condenser 73 where the stream is cooled before passing by way of line 74 to the solvent recovery column overhead accumulator 80. The water in the accumulator 80 passes by way of line 81 to the raffinate water wash section. Part of the extract from the accumulator is employed as reflux in the solvent recovery column along lines 82 and 83, while the remainder of the extract passes by way of lines 82 and 84 to the extract adsorption bed 40B where the sulfolane found in the extract stream is adsorbed onto the solid adsorbent. The sulfolane-free extract passes by way of line 85 to further downstream processing. Once the solid adsorbent in bed 40B has reached its equilibrium capacity, the extract stream will be switched to bed 40A which has previously been regenerated, and then bed 40B is regenerated by passing extraction feed through the bed. In this manner, continuous operation of the invention may be attained.

Not shown in FIG. 1 is an extract water wash. This extract water wash, which would function similarly to the raffinate water wash, could be placed in the process along line 84 so as to reduce the sulfolane content of the extract stream before the extract stream contacts the adsorbent beds.

Figure 2:
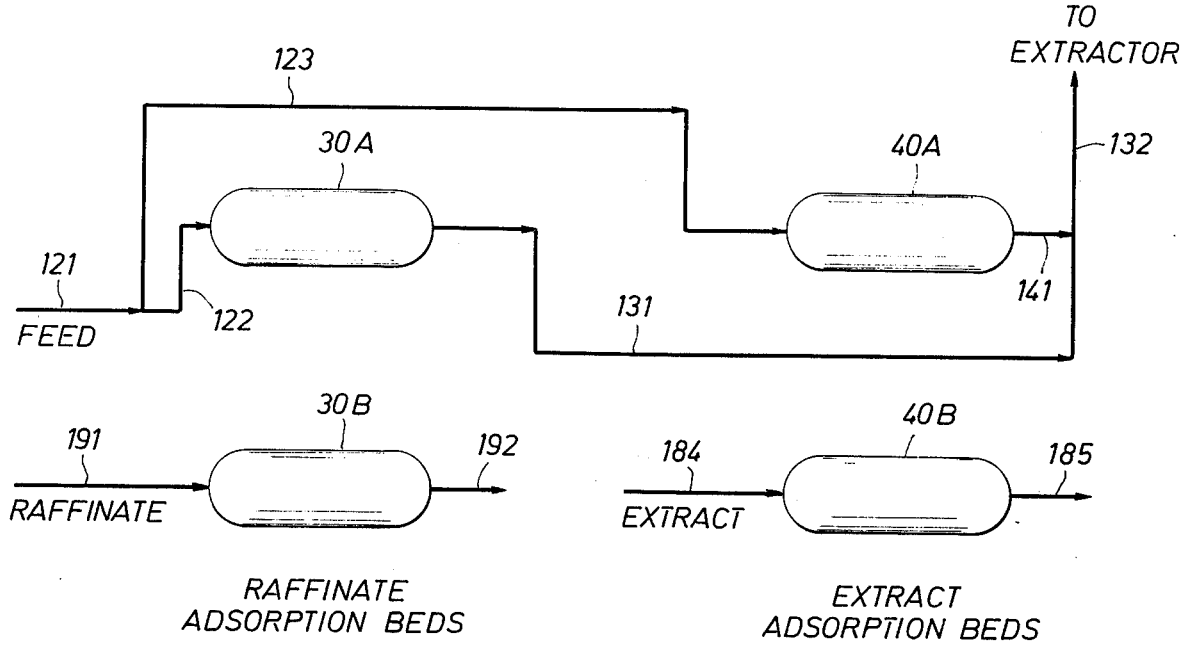
FIG. 2 shows the adsorption beds of FIG. 1 separately.

FIG. 2 depicts the adsorption beds in the service mode shown in FIG. 1. Raffinate adsorption bed 30A and extract adsorption bed 40A which had previously been contacted with the sulfolane-rich raffinate and extract streams are contacted with hot extraction process feed along lines 121, 122 and 123 whereby the extraction process feed displaces the adsorbed sulfolane. The sulfolane containing extraction process feed then passes along lines 131, 141 and 132 to the Extractor. Meanwhile, sulfolanerich raffinate along line 191 contacts raffinate adsorption bed 30B, wherein the sulfolane is adsorbed onto the solid adsorbent and the sulfolane-free raffinate passes by way of line 192. Likewise, sulfolane-rich extract along line 184 contacts the extract adsorption bed 40B wherein the sulfolane is adsorbed onto the solid adsorbent and the sulfolane-free extract passes by way of line 185 to further processing.

Figure 3:
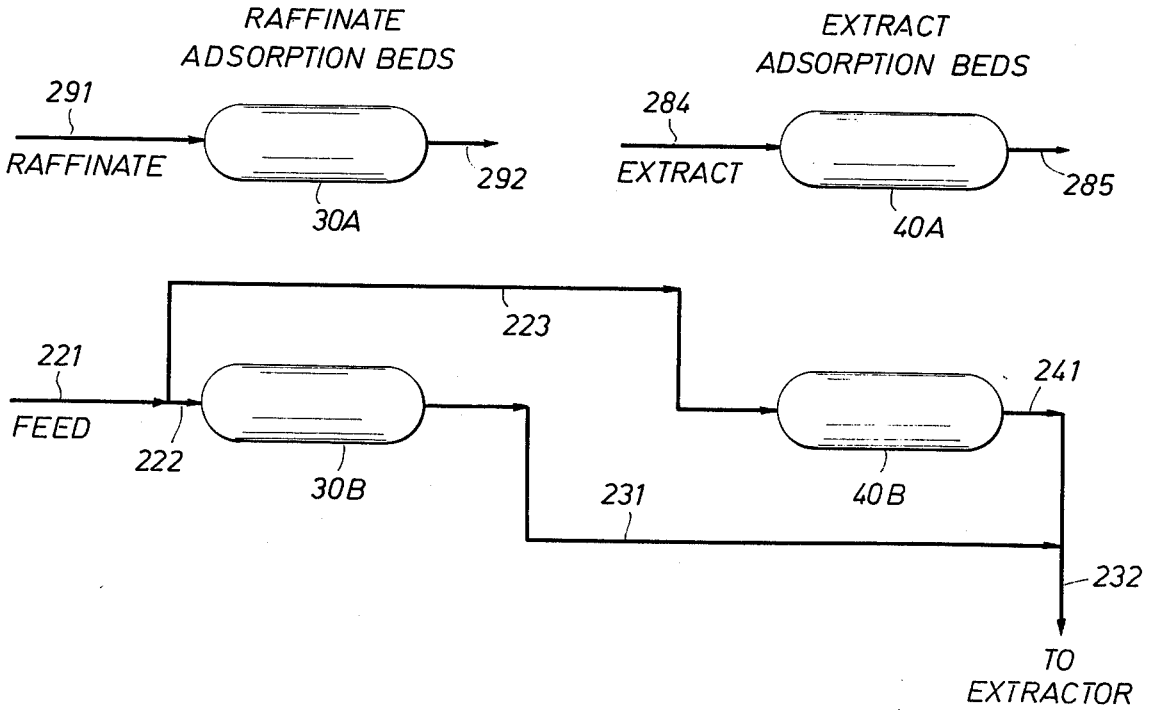
FIG. 3 shows the individual adsorption beds of FIG. 2 switched from the adsorption cycle to the regeneration cycle and from the regeneration cycle to the adsorption cycle.

Once adsorption beds 30A and 40A have been regenerated and adsorption beds 30B and 40B have reached their equilibrium capacities, the service mode of the adsorption beds are switched as shown in FIG. 3. Referring to FIG. 3, hot extraction feed contacts the raffinate adsorption bed 30B along lines 221 and 222 and the extraction adsorption bed 40B along lines 221 and 223 whereby the extraction process feed displaces the adsorbed sulfolane. The sulfolane containing process feed then passes along lines 231, 241, and 232 to the Extractor. Previously regenerated raffinate adsorption bed 30A is then contacted with sulfolane-rich raffinate along line 291 wherein the sulfolane is adsorbed onto the solid adsorbent and the sulfolane-free raffinate passes by way of line 292. Previously regenerated extract adsorption bed 40A is likewise contacted with sulfolane-rich extract along line 284 and the sulfolane-free extract passes by way of line 285 to further processing.

From FIGS. 1, 2 and 3 it is seen how that continuous operation of the invention is employed in an extraction process.

The above embodiment is described for purposes of illustration only and should not be construed as a limitation on the claims which follow.

We claim as our invention:

1. A process for reducing the amount of sulfolane-type solvent present in the extract product stream obtained by contacting a liquid mixture containing compounds having differing polarities with a sulfolane-type solvent in an extraction zone and in which said sulfolane-type solvent is recovered, such process comprising:

a. contacting said extract product stream with a silica gel adsorbent at temperature $T_1$ wherein the sulfolane-type solvent entrained or otherwise present in said extract product stream is adsorbed onto the silica gel adsorbent thereby producing an extract product stream containing reduced amounts of sulfolane-type solvent; and b. contacting the silica gel adsorbent and the sulfolane-type solvent adsorbed thereon with the liquid mixture feed to the extraction zone at temperature $T_2$ wherein temperature $T_2$ is greater than temperature $T_1$, thereby regenerating the silica gel adsorbent by displacing the sulfolane-type solvent adsorbed onto the silica gel adsorbent with the liquid mixture feed.

2. A process according to claim 1 wherein the sulfolane-type solvent is sulfolane.

3. A process according to claim 2 wherein the liquid mixture is a hydrocarbon fraction containing benzene, toluene, and xylene; the extract product stream is a mixture of benzene, toluene and xylene; temperature $T_1$ is from about 20°C to about 30°C; and temperature $T_2$ is from about 70°C to about 80°C.

4. A process according to claim 1 wherein the silica gel adsorbent is provided in two or more adsorption vessels so that the silica gel adsorbent in one or more adsorption vessels may be regenerated while the silica gel adsorbent in the remaining adsorption vessels is being employed to remove sulfolane-type solvent from said extract product stream.

5. In the process for the separation of a liquid mixture containing compounds having differing polarities by contacting said liquid mixture with a sulfolane-type solvent in an extraction zone thereby forming a fat solvent bottoms stream and a raffinate product overhead stream, wherein the fat solvent bottoms stream is routed to a solvent recovery zone in which the sulfolane-type solvent is recovered as the bottoms stream and in which the overhead stream is the extract stream and in which said extract stream is split into a solvent recovery zone reflux stream and an extract product stream, an improvement which comprises:

a. reducing the solvent recovery zone reflux stream thereby permitting increased amounts of sulfolane-type solvent to pass overhead with the extract product stream;

b. contacting said extract product stream with a silica gel adsorbent at temperature $T_1$ wherein the sulfolane-type solvent present in said extract product stream is adsorbed onto the silica gel adsorbent thereby producing an extract product stream containing reduced amounts of sulfolane-type solvent; and c. contacting the silica gel adsorbent and adsorbed sulfolane-type solvent with the liquid mixture feed to the extraction zone at temperature $T_2$ wherein temperature $T_2$ is greater than temperature $T_1$ so as to regenerate the silica gel adsorbent by displacing the sulfolane-type solvent from the silica gel adsorbent with the liquid mixture feed.

6. A process according to claim 5 wherein the liquid mixture is a hydrocarbon fraction containing benzene, toluene, and xylene; temperature $T_1$ is from about 20°C to about 30°C; temperature $T_2$ is from about 70°C to about 80°C; and the sulfolane-type solvent is sulfolane.

* * * * *